United States Patent [19]

Kabilka et al.

[11] Patent Number: 4,843,810

[45] Date of Patent: Jul. 4, 1989

[54] APPARATUS FOR INCLINATION ADJUSTMENT OF A TRAVELING SERVICE UNIT FOR A TEXTILE SPINNING MILL MACHINE

[75] Inventors: Otto Kabilka, Munich; Otto Weich, Schlagenhofen; Herbert Grassle, Gmund-Metlangen; Hans-Peter Weeger, Hattenhofen, all of Fed. Rep. of Germany

[73] Assignee: Zinser Textilmaschinen GmbH, Fed. Rep. of Germany

[21] Appl. No.: 128,133

[22] Filed: Dec. 3, 1987

[30] Foreign Application Priority Data

Dec. 4, 1986 [DE] Fed. Rep. of Germany ..... 3641481

[51] Int. Cl.[4] ..... D01H 9/10; B62D 37/00; B60S 9/00; B61F 11/00

[52] U.S. Cl. ..... 57/268; 105/164; 104/243; 104/245; 250/6.1; 180/41

[58] Field of Search ..... 104/242, 243, 244.1, 104/245; 105/82, 164, 180, 209; 280/6.1, DIG. 1; 180/41; 57/268, 271

[56] References Cited

U.S. PATENT DOCUMENTS

| | | | |
|---|---|---|---|
| Re. 30,702 | 8/1981 | Keller et al. | 57/268 |
| 2,568,402 | 9/1951 | Lynn | 105/82 X |
| 3,404,746 | 10/1968 | Slay | 104/245 X |
| 3,618,531 | 11/1971 | Eichholz | 104/245 X |
| 3,707,926 | 1/1973 | Ellzey | 105/164 X |
| 4,140,420 | 2/1979 | Swisher, Jr. et al. | 180/41 X |
| 4,583,358 | 4/1986 | Krieger et al. | 57/268 X |

FOREIGN PATENT DOCUMENTS

| | | | |
|---|---|---|---|
| 0578426 | 6/1958 | Italy | 180/41 |
| 0261714 | 12/1985 | Japan | 280/6.1 |

*Primary Examiner*—Andres Kashnikow
*Assistant Examiner*—Richard Potosnak
*Attorney, Agent, or Firm*—Shefte, Pinckney & Sawyer

[57] ABSTRACT

In a traveling service unit of the type utilized in conjunction with a textile spinning mill machine, the transverse and longitudinal inclination of the service unit with respect to the machine is monitored and adjusted with respect to a fixed horizontal reference plane by at least two electronic levels or like inclination detectors each operatively connected through an associated controller with a vertically-adjustable roller wheel supporting assembly of the service unit for controlling the elevation of the service unit at each supporting assembly to compensate for detected inclination deviations.

14 Claims, 3 Drawing Sheets

APPARATUS FOR INCLINATION ADJUSTMENT OF A TRAVELING SERVICE UNIT FOR A TEXTILE SPINNING MILL MACHINE

BACKGROUND OF THE INVENTION

The present invention relates to an apparatus for adjustment of the inclination of a service unit adapted for traveling operational movement along a textile spinning mill machine.

Traveling service units of the aforementioned type are commonly operated in association with various machines in textile spinning mills for automatically performing servicing operations such as doffing and donning of bobbins and piecing of broken yarn ends. As is known, such traveling service units must be precisely adjusted in their inclination in both transverse and longitudinal directions with respect to the associated machine in order for the service unit to function reliably.

It has been suggested in the prior art that inclination adjustment of traveling serivce units may be achieved by guiding the service unit on a rail arranged along the textile machine frame for the purpose of precisely adjusting the disposition of the service unit with respect to the machine. However, in this arrangement, the entire weight of the traveling service unit, which often is considerable, hangs from the rail and, therefore, the machine frame must be suitably reinforced. As a result, this arrangement is relatively expensive and in any event does not reliably eliminate the risk of detrimental deformation of the support arrangement under the weight of the traveling service unit.

It has also been suggested to provide traveling service units with floor-supported rollers to transfer a part of the weight of the unit directly to the floor adjacent the associated textile machine so that the guide rail is required to support only a portion of the weight of the traveling service unit. To achieve adjustment of the traveling service unit in longitudinal and transverse directions with respect to the associated spinning mill machine, the supporting rollers are arranged at spacings from one another to provide a desired horizontal disposition of the service unit in the longitudinal direction of the associated machine, while a suitable powered mechanism, e.g. hydraulic elements, are associated with the supporting rollers to provide vertical adjustment of the unit transversely with respect to the machine. Hereagain, however, the frame of the textile machine is still required to support a considerable portion of the weight of the traveling service unit.

SUMMARY OF THE INVENTION

It is accordingly an object of the present invention to provide an arrangement for precisely adjusting the inclination of a traveling service unit for a textile spinning mill machine with respect to a fixed reference plane without the necessity of placing a load on the machine frame.

The foregoing object of the present invention is met by providing a traveling service unit with means for detecting the inclination of the unit with respect to the predetermined fixed reference plane, in association with supporting means for the service unit selectively adjustable for adjusting the inclination of the unit with respect to the reference plane and control means operatively associated with the detecting means and the supporting means for controlling adjustment of the supporting means in response to inclination deviations detected by the detecting means. Preferably, the reference plane is horizontal.

In one embodiment, the detecting means includes a first detector for sensing inclination of the traveling service unit transversely with respect to the reference plane and a second detector for sensing inclination of the unit longitudinally with respect to the reference plane. The supporting means includes a plurality of support assemblies for the traveling service unit, the control means providing a first controller arranged to control adjustment of at least one support assembly in response to deviations detected by the first detector and a second controller arranged to control adjustment of at least one other support assembly in response to deviations detected by the second detector. As desirable, the first and second controllers may be operatively associated for interrelated operation. Further, the first controller may be arranged to control opposing adjustments of a pair of support assemblies. In this manner, the present apparatus is operative to adjust the inclination of the service unit to diminish deviations detected by the detectors.

According to another embodiment of the present invention, a guide rail is arranged as a reference longitudinally along the spinning mill machine and a guide element guides the traveling service unit along the guide rail, the guide element being operatively associated with the detector means for operation of the guide element as a feeler. Preferably, a plurality, e.g. three, of the feeler guide elements are arranged in spaced parallel relation, each comprising a lever arm pivotably mounted at one end to the traveling service unit about a horizontal pivot axis adjacent the supporting means and being guided at the opposite end along the reference guide rail. The supporting means includes three support assemblies for the traveling service unit and the control means comprises three controllers each arranged to control adjustment of a respective support assembly in response to a respective feeler guide element. Two of the controllers may be operatively associated for interrelated operation.

As desired, the supporting means may comprise a plurality of roller assemblies mounted to the traveling service unit for rolling floor engagement, with each roller assembly being adjustable vertically relative to the traveling service unit for elevational adjustment thereof. In one embodiment, the traveling service unit includes superposed upper and lower sections with the upper section containing the servicing components of the unit, the roller assemblies being mounted to the lower section and including a plurality of elevating assemblies arranged between the upper and lower sections for adjustment of the inclination of the upper section.

DESCRIPTION OF THE PREFERRED EMBODIMENT

Figure 1:
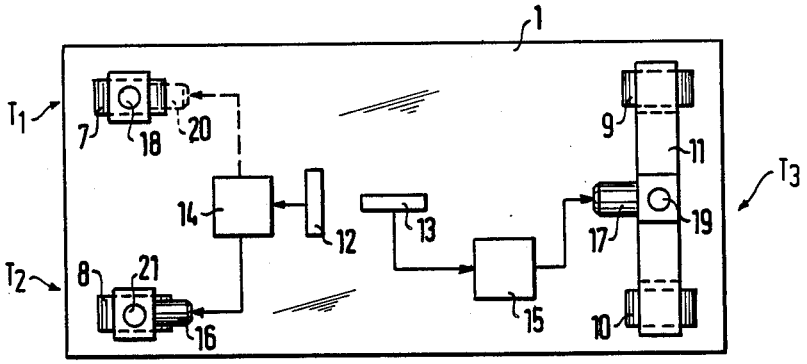
FIG. 1 is a schematic plan view of a traveling service unit in accordance with one embodiment of the present invention.

Referring now to the accompanying drawings and initially to FIG. 1, there is schematically indicated at 1 a traveling service unit representative of the aforementioned type adapted for traveling operational movement lengthwise along an associated machine (not shown) in a textile spinning mill. According to the present invention, the service unit 1 is provided with two detectors 12,13 each adapted for sensing inclination of the unit 1 with respect to the associated machine as related to a predetermined fixed horizontal reference plane, the detector 12 being arranged for detecting inclination of the service unit 1 transversely with respect to the reference plane while the detector 13 is arranged for sensing inclination of the unit 1 longitudinally with respect to the reference plane. The detector 12 is operatively connected with a controller 14 to signal thereto sensed deviations in transverse inclination of the unit 1. Similarly, the detector 13 is operatively connected with a controller 15 for signaling thereto sensed deviations in the longitudinal inclination of the unit 1.

The traveling service unit 1 is supported for traveling movement on the floor surface adjacent the associated machine on three supporting roller assemblies, generally indicated at T1, T2 and T3 arranged in triangular relation to one another when viewed in plan as depicted in FIG. 1. At least two of the support assemblies, e.g. T1,T2, are arranged for adjusting the elevation of the traveling service unit 1 at their respective supporting locations, thereby to adjust the inclination of the service unit 1 with respect to horizontal. As desired, the third supporting assembly T3 may similarly be arranged for elevational adjustment of the service unit 1. The supporting assemblies T1,T2,T3 may be of any desired construction having relatively movable elements, one of which may be mounted or otherwise braced against the traveling service unit 1 for relative vertical movement thereof, e.g. a screw spindle and nut assembly, a rack and pinion unit, a piston-cylinder unit, and the like.

In the embodiment depicted in FIG. 1, each of the supporting roller assemblies T1,T2,T3 include screw spindle and nut assemblies for elevational inclination adjustment. In each of the supporting assemblies T1,T2, the respective screw spindle 18,21 is arranged in upright disposition with a respective roller wheel 7,8 rotatably mounted to the lower spindle end and having the associated nut supported within the housing of the traveling service unit 1 in threaded engagement with the respective spindle 18,21 for operative rotation by a respective motor 20,16. Similarly. the supporting assembly T3 includes an upright screw spindle 19 having an undercarriage 11 mounted to the lower end of the spindle and rotatably supporting a pair of roller wheels 9,10, with the associated meshing nut being supported within the housing of the service unit 1 for operative rotation by a motor 17, thereby defining a tilting axis along the length of the undercarriage 11.

The motor 16 associated with the supporting assembly T2 is operatively connected with the controller 14 to be controlled thereby in accordance with deviations in the transverse inclination of the service unit 1 sensed by the detector 12 so as to adjust the unit 1 vertically to compensate for such deviations. Accordingly, the supporting assembly T1 need not be vertically adjustable in this embodiment. On the other hand, it is possible and may be advantageous for both supporting assemblies T1 and T2 to be vertically adjustable by control of their respective motors 16,20 in opposite directions by the controller 14, thereby to achieve particularly effective adjustment of the transverse inclination of the service unit 1. Thus, the controller 14 may be arranged in operative controlling association with either one or both of the motors 16,20 associated with the supporting assemblies T1 and T2, as depicted in FIG. 1.

In like manner, the controller 15 is operatively connected with the motor 17 associated with the supporting assembly T3 to control operation of the motor 17 in response to the deviations in longitudinal inclination of the service unit 1 sensed by the detector 13, thereby to elevate the undercarriage 11 to incline the service unit 1 longitudinally to compensate for and diminish such deviations. As desired, the controllers 14 amd 15 may be operatively connected for interrelated operational control of the motors 16,17,20.

Thus, the present invention makes possible the detection of the transverse inclination and the longitudinal inclination of the traveling service unit 1 through the detectors 12 and 13 and enables the orientation of the traveling service unit 1 precisely with respect to the predetermined horizontal reference plane for precise disposition of the unit 1 relative to the associated textile machine.

Figure 2:
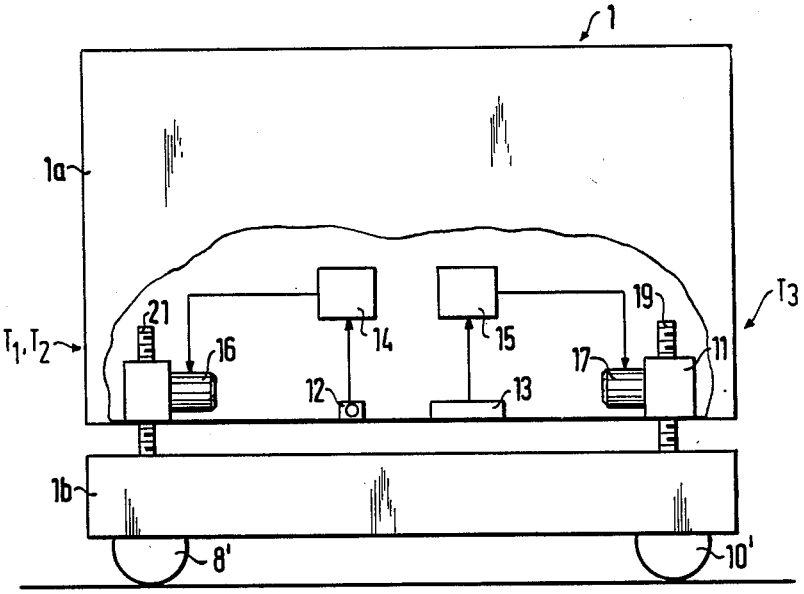
FIG. 2 is a schematic, side elevational view, partially broken away, of another embodiment of a traveling service unit according to the present invention.

FIG. 2 depicts an alternative embodiment similar to FIG. 1 but wherein the traveling service unit 1 includes upper and lower sections 1a,1b arranged in superposed relation to one another by supporting roller assemblies T1,T2,T3 of the type described above in FIG. 1 for elevating the upper section 1a with respect to the lower section 1*b* for adjusting the relative longitudinal and transverse inclination of the upper section 1*a*. In this embodiment, the roller wheels of the supporting assemblies T1,T2,T3, e.g. roller wheels 8',10', are mounted on the lower section 1*b* for foor support of the traveling service unit 1, with respective screw spindles, e.g. spindles 19,21, extending in upstanding relation from the roller wheels into threaded engagement with associated nuts mounted within the housing of the upper section 1*a*. Within the upper section 1*a*, a pair of transverse and longitudinal inclination detectors 12,13 are mounted in operative association with respective controllers 14,15 which are operatively connected respectively with motors, e.g. motors 16,17, associated with the respective screw spindle and nut assemblies.

Figure 3:
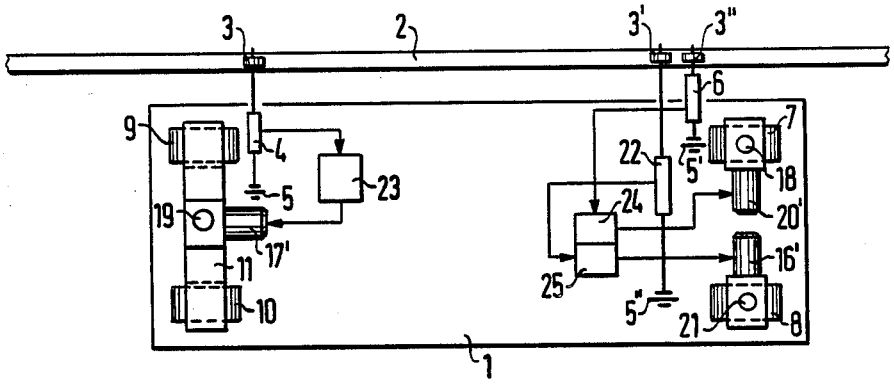
FIG. 3 is a schematic plan view of a third possible embodiment of a traveling service unit according to the present invention.
Figure 4:
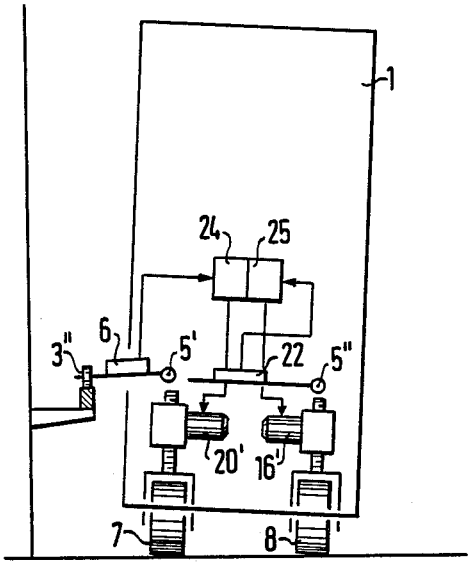
FIG. 4 is a schematic end elevational view, partially broken away, of the traveling service unit of FIG. 3.

In a further embodiment of the present invention shown in FIGS. 3 and 4, a reference guide rail 2 is mounted longitudinal along the associated textile spinning mill machine and three rail feeler elements 3,3',3'' are pivotably mounted on the traveling service unit 1 in spaced parallel relation about respective parallel pivot axes 5,5',5'', for sensing engagement with the reference rail 2 during traveling movement of the service unit 1 along the textile machine. The pivot axes 5,5',5'' of the feeler elements 3,3',3'' are located closely to the respective supporting assemblies for the service unit 1, with each feeler element supporting a respective inclination detectors 4,6,22. The inclination detector 4 is operatively connected with the controller 23 which is operatively associated with a motor 17′ associated with the supporting assembly comprising the roller wheels 9,10, the undercarriage 11, and the screw spindle 19. Similarly, the inclination detector 6 is operatively associated through a controller 24 with a motor 20′ associated with the supporting assembly comprising the roller wheel 7 and screw spindle 18. In like manner, the inclination detector 22 is operatively connected through a controller 25 with a motor 16′ associated with the supporting assembly comprising the roller wheel 8 and the screw spindle 21.

The inclination detectors 4,6,22 sense any inclination of the respective feeler elements 3,3′,3″ and thereby recognize any vertical deviation relative to the reference rail 2 occurring at the respective supporting assemblies of the traveling service unit 1. As will be understood, since each of the feeler elements is in sensing engagement with the same reference rail 2, the adjusting compensation for sensed vertical deviations carried out by the associated controllers and motors results in maintenance of a proper level deposition of the traveling service unit 1. As desired, the controller 24 associated with the inclination detector 6 and motor 20′ may be operatively connected with the controller 25 associated with the inclination detector 22 and motor 16′. As in the above-described embodiment of FIG. 1, the motors 16′,20′ may be controlled in opposite directions by their respective controllers 25,24 for correcting deviations in the transverse inclination of the service unit 1 detected by the associated detectors 6,22. Thus, by the cooperative setting of the elevation of the axes of rotation 5,5′,5″ and the detectors 4,6,22 of the feeler elements 3,3′,3″, a precisely uniform height of the traveling service unit 1 may be achieved at each of its three supporting assemblies to thereby achieve precise adjustment of the relative inclination of the unit 1. This arrangement provides the additional advantage of maintaining the elevation of the traveling service unit 1 in correspondence to the elevation prescribed by the reference rail 2.

Figure 6:
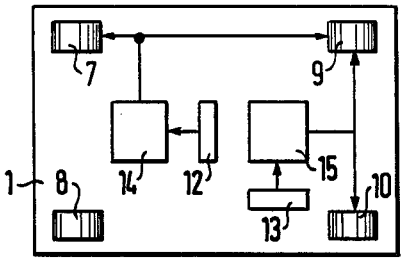
FIG. 6 is a schematic plan view of a fourth possible embodiment of a traveling service unit according to the present invention.

Of course, as will be understood from the above-discussed embodiments of FIGS. 1 and 3, the supporting roller assemblies may, as desired, be designed as individual roller assemblies for each supporting roller wheel or as an undercarriage assembly 11 for two or more of the supporting roller wheels. By way of example, FIG. 6 shows another embodiment of the present invention wherein each of four supporting roller wheel assemblies 7,8,9,10 are individually mounted to the traveling service unit 1. In this embodiment, the roller wheel assemblies 7,9 and 10 are each individually adjustable vertically by means of controllers 14,15 which are operatively associated with transverse and longitudinal inclination detectors 12,13. The controller 14 is operatively connected with each of the supporting roller assemblies 7,9 for controlling their vertical adjustment, while the controller 15 is operatively connected with the roller assemblies 9,10 for controlling their vertical adjustment. In this manner, the control arrangement of this embodiment enables inclination adjustment of the traveling service unit 1 in both its longitudinal and transverse directions.

Figure 5:
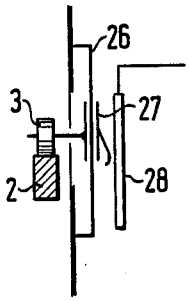
FIG. 5 is a schematic illustration of an alternate embodiment of inclination detector for use in the present invention.

In each of the embodiments of FIGS. 1–4, electronic level-detecting devices are utilized as the detectors 12,13. On the other hand, a slide-type inclination detector as illustrated in FIG. 5 may alternatively be utilized. With such a detector, the feeler element 3 is mounted to a slide element 27 arranged for sliding vertical movement on a guide rod 26. The slide element 27 is operatively associated with a potentiometer 28 or the like to cause an electrical signal to be generated and transmitted through the associated controller (not shown) to the corresponding drive of the respective support assembly, e.g. the nut-driving motor of a screw spindle, thereby to actuate vertical adjustment of the supporting assembly to produce corresponding inclination adjustment of the traveling service unit relative to the textile spinning mill machine.

Figure 7:
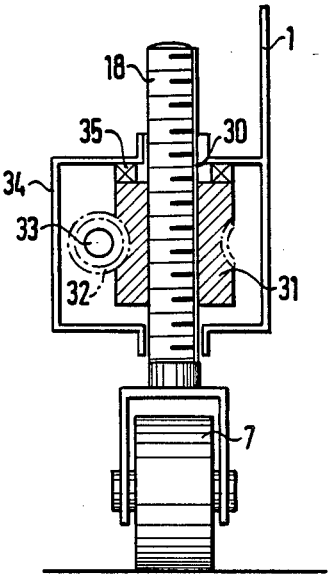
FIG. 7 is an end view in vertical cross-section of a support assembly for a traveling service unit in accordance with the present invention.

FIG. 7 depicts a representative supporting assembly as may be utilized in the present invention for vertical adjustability of the traveling service unit 1. In this supporting assembly, a screw spindle 18 is fixed in upright disposition to a fork member which rotatably supports an associated roller wheel 7, with the screw spindle 18 extending upwardly through a housing portion 34 of the traveling service unit 1 and locked against rotation through a tongue and groove connection 30. An annular nut 31 is disposed within the housing portion 34 in threaded connection about the screw spindle 18, the outer periphery of the nut 31 also being in threaded driven engagement with a worm gear 32 mounted within the housing portion 34 to the drive shaft 33 of an associated control motor (not shown). A thrust bearing 35 is provided between the housing portion 34 and the nut 31. As will thus be understood, upon rotation of the nut 31 by the worm gear 32, the nut 31 is caused to travel upwardly or downwardly along the screw spindle 18, depending upon the direction of worm gear rotation, to produce corresponding vertical adjustment of the traveling service unit 1 at the location of the supporting assembly, thereby to produce a desired change in the inclination of the service unit 1 as determined by an associated inclination detector and controller.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptions, variations, modifications and equivalent arrangements, the present invention being limited only by the claims appended hereto and the equivalents thereof.

We claim:

1. In combination, a textile spinning mill machine, a service unit for traveling movement along said spinning mill machine for performing servicing operations thereon, and apparatus for inclination adjustment of said traveling service unit with respect to said spinning mill machine, said inclination adjustment apparatus comprising means for detecting inclination of the traveling service unit with respect to a fixed reference plane having a predetermined relationship to said spinning mill machine, means for supporting said traveling service unit and being selectively adjustable for adjusting the inclination of said traveling service unit with respect to said reference plane, and control means operatively associated with said detecting means and said supporting means for controlling adjustment of said supporting means in response to inclination deviations detected by said detecting means.

2. The combination according to claim 1 and characterized further in that said reference plane is horizontal.

3. The combination according to claim 1 or 2 and characterized further in that said detecting means comprises a first detector for sensing inclination of said traveling service unit transversely with respect to said reference plane and a second detector for sensing inclination of said traveling service unit longitudinally with respect to said reference plane, said control means being operable to actuate adjustment of said supporting means to diminish deviations detected by said detectors.

4. The combination according to claim 3 and characterized further in that said supporting means comprises a plurality of support assemblies for said traveling service unit, said control means including a first controller arranged to control adjustment of at least one said support assembly in response to deviations detected by said first detector and a second controller arranged to control adjustment of at least one other support assembly in response to deviations detected by said second detector.

5. The combination according to claim 4 and characterized further in that said first controller is arranged to control opposing adjustment of a pair of support assemblies.

6. The combination according to claim 4 and characterized further in that said first and second controllers are operatively associated for interrelated operation.

7. The combination according to claim 1 and characterized further by a guide rail arranged as a reference longitudinally along the spinning mill machine and a feeler guide element arranged for engagement with said reference guide rail for guiding the traveling service unit therealong and being operatively associated with said detecting means for detection thereby of inclination deviations of said feeler guide element relative to said reference guide rail.

8. The combination according to claim 7 and characterized further in that said feeler guide element comprises a lever arm pivotably mounted at one end to said traveling service unit about a horizontal pivot axis adjacent said supporting means and being guided at the opposite end of said lever arm along said reference guide rail.

9. The combination according to claim 8 and characterized further by a plurality of said feeler guide elements arranged in spaced parallel relation about respective pivot axes parallel to said reference guide rail.

10. The combination according to claim 8 and characterized further in that said supporting means comprises three support assemblies for said traveling service unit and said control means comprises three controllers each arranged to control adjustment of a respective support assembly in response to a respective feeler guide element.

11. The combination according to claim 10 and characterized further in that two of said controllers are operatively associated for interrelated operation.

12. The combination according to claim 1 and characterized further in that said supporting means comprises a plurality of roller assemblies mounted to the traveling service unit for rolling floor engagement, each roller assembly being adjustable vertically relative to the traveling service unit.

13. The combination according to claim 1 and characterized further in that said supporting means comprises a plurality of support assemblies for the traveling service unit, each support assembly being arranged for elevating said traveling service unit, one support assembly being mounted to an undercarriage associated with the traveling service unit.

14. The combination according to claim 1 and characterized further in that the traveling service unit comprises an upper section and a lower section arranged in superposed relation to one another, said upper section containing the servicing components of the traveling service unit, said supporting means comprising a plurality of rollers mounted to said lower section and a plurality of elevating assemblies arranged between said upper and lower sections for adjusting the inclination of said upper section.

* * * * *